United States Patent [19]

Daussan et al.

[11] Patent Number: 4,576,365

[45] Date of Patent: Mar. 18, 1986

[54] DEVICE FOR THE REMOVAL OF INCLUSIONS CONTAINED IN MOLTEN METALS

[75] Inventors: Jean-Charles Daussan, Metz; André Daussan, Longeville les Metz; Gérard Daussan, Metz, all of France

[73] Assignee: Daussan et Compagnie, Woippy, France

[21] Appl. No.: 604,602

[22] Filed: Apr. 27, 1984

Related U.S. Application Data

[62] Division of Ser. No. 438,491, Nov. 2, 1982, Pat. No. 4,468,012.

[30] Foreign Application Priority Data

Nov. 13, 1981 [FR] France ..... 8121229

[51] Int. Cl.[4] ..... C21C 5/48

[52] U.S. Cl. ..... 266/220; 266/236

[58] Field of Search ..... 266/217, 220, 236; 222/603, 591, 590, 597; 164/437, 438

[56] References Cited

U.S. PATENT DOCUMENTS

| | | | |
|---|---|---|---|
| 1,073,587 | 9/1913 | Billings | 266/217 |
| 3,380,727 | 4/1968 | Rüttiger et al. | 266/220 |
| 4,202,533 | 5/1980 | Daussan et al. | 266/236 |

FOREIGN PATENT DOCUMENTS

| | | | |
|---|---|---|---|
| 0066492 | 12/1982 | European Pat. Off. | 164/437 |
| 0126631 | 10/1979 | Japan | 164/437 |
| 0102357 | 8/1981 | Japan | 164/437 |
| 8201836 | 1/1982 | PCT Int'l Appl. | 222/603 |

*Primary Examiner*—L. Dewayne Rutledge
*Assistant Examiner*—S. Kastler
*Attorney, Agent, or Firm*—Young & Thompson

[57] ABSTRACT

The device for removing inclusions and especially oxides of the molten metal which is poured into a casting tundish comprises elements which are placed within the interior of the casting tundish and immersed in the molten metal. The elements are formed of heat-insulating material which is sinterable at the temperature of the molten metal. A duct is formed within the interior of the elements and connected to a supply of gas such as argon which is inert with respect to the molten metal.

2 Claims, 7 Drawing Figures

FIG. 5
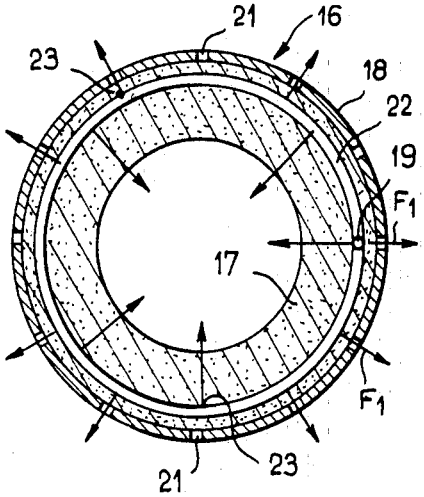
FIG. 6
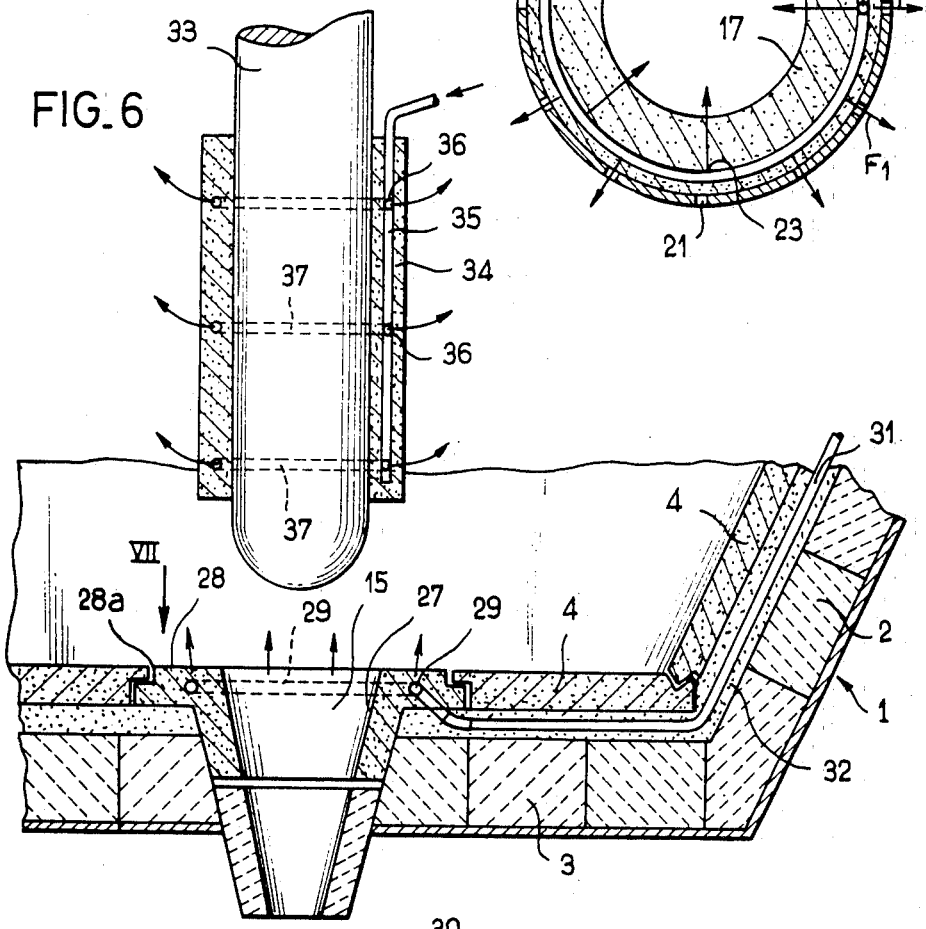
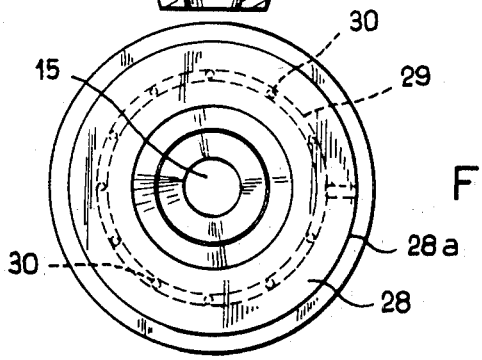
FIG. 7

DEVICE FOR THE REMOVAL OF INCLUSIONS CONTAINED IN MOLTEN METALS

This application is a division of application Ser. No. 438,491, filed 11/2/82, now U.S. Pat. No. 4,468,012.

This invention relates to a device for removing inclusions and especially oxides from the molten metal which is poured into a casting tundish.

These inclusions are caused by oxidation of the molten metal with air or impurities such as alumina and other metal or metalloid oxides which may or may not be intentionally incorporated in the metal during the different casting operations.

Said inclusions are very often responsible for the poor quality of the metal obtained. It is therefore necessary to take precautions in order to prevent the formation of such inclusions.

In order to limit oxidation of the molten metal which is poured into the casting tundish, the molten metal bath is usually covered with a blanket powder of refractory material having lower density than the molten metal. However, this blanket powder does not entirely prevent the formation of inclusions. In fact, the violent movements of convection of molten metal which take place within the casting tundish at the time of pouring of this metal into the tundish are liable to produce a displacement in the downward direction, that is to say towards the pouring outlets, of solid particles which originate from the blanket powder and thus form inclusions. Furthermore, the inclusions initially contained within the metal which is poured into the tundish can obviously not be eliminated by means of this blanket powder.

The object of the present invention is to produce a device which permits effective removal of these inclusions.

According to the invention, the device aforesaid essentially comprises elements which are placed within the interior of the casting tundish and intended to be immersed in the molten metal, said elements being formed of heat-insulating material which is sinterable at the temperature of the molten metal and is composed of inorganic particles incorporated in a binder. A duct is formed within the interior of said elements and intended to be connected to a supply of gas such as argon which is inert with respect to the molten metal.

The material which constitutes said elements sinters in contact with the molten metal and becomes porous. The pores thus formed serve to guide the inert gas such as argon from the duct formed within said elements to the molten metal in which these latter are immersed. The inert gas jets formed at the surface of said porous elements rise to the surface of the molten metal and entrain towards said surface the inclusions of oxides and other impurities contained in the molten metal. The elements become porous as they come into contact with the molten metal and a judicious arrangement of these latter in spaced relation permits complete removal of inclusions and consequently makes it possible to obtain a metal of very high purity and of excellent quality.

In an advantageous embodiment of the invention, the elements consist of blocks of elongated shape, designated hereinafter as "long blocks". The duct aforesaid passes right through said blocks from one end to the other. The blocks themselves each extend to the full height of the side wall and across the entire width of the bottom wall of the casting tundish.

Preferably, the long blocks which are placed against the side wall of the casting tundish are joined to the opposite ends of blocks laid on the bottom wall of the casting tundish in order to establish a communication between the ducts of said side-wall blocks and bottom-wall blocks.

There is thus formed within the casting tundish a series of barriers constituted by inert gas jets formed throughout the mass of molten metal contained within the casting tundish with the result that the inclusions are effectively driven towards the surface of the molten metal.

In a particularly advantageous embodiment of the invention, the long blocks are inserted between the detachable heat-insulating plates which line the side walls and the bottom wall of the casting tundish.

The molten metal is usually poured into the casting tundish by means of a casting tube which dips in the molten metal bath contained in said tundish. Said casting tube is provided with an internal lining of sinterable heat-insulating material of the same type as the material of the plates which cover the side walls and the bottom wall of the casting tundish.

In a preferred embodiment of the invention, said casting tube comprises a pipe which is intended to be connected to an inert gas supply and is embedded in the sinterable heat-insulating lining. One end of said pipe has its opening at the exterior of the casting tube in proximity to the upper portion of this latter. The other end of the pipe has its opening at the lower end of the casting tube, namely the end to be immersed in the molten metal bath which is poured into the casting tundish.

Jets of inert gas are thus formed at the lower end of the casting tube. Said jets pass through the pores formed after sintering of the lining and have the effect of driving towards the surface of the molten metal any inclusions contained within this latter in the zone adjacent to the casting tube. In conjunction with the long blocks placed within the casting tundish, the arrangement just described accordingly contributes to the removal of inclusions from the molten metal.

The pouring outlets of the casting tundish can be lined with a detachable sleeve of sinterable heat-insulating material of the same type as the plates of the casting tundish and the casting tube lining.

In another embodiment of the invention, said sleeve is provided in the portion which is adjacent to the interior of the casting tundish with a pipe which is embedded in the material of the sleeve and provided with orifices for the discharge of inert gas.

By virtue of this arrangement, the inclusions located within the molten metal in the vicinity of the pouring outlet can be driven upwards by the gas jets which are thus formed.

The stopper rod which controls the opening and closing of the pouring outlets of the casting tundish can be surrounded externally by a detachable sleeve of sinterable heat-insulating material.

In another embodiment of the invention, said sleeve is provided on that portion which is adjacent to the interior of the casting tundish with a pipe embedded in the material of the sleeve and having orifices for the discharge of inert gas.

Together with those described earlier, this arrangement also contributes to the removal of inclusions contained in the molten metal.

Other features of the invention will be more apparent to those skilled in the art upon consideration of the following description and accompanying drawings, wherein:

FIG. 5 is a sectional view taken along the plane V—V of FIG. 4;

FIG. 6 is a longitudinal sectional view of devices according to the invention which equip a stopper rod and pouring outlet of a casting tundish;

FIG. 7 is a view taken along the arrow VII of FIG. 6 and showing the sleeve inserted in the pouring outlet.

Figure 1:
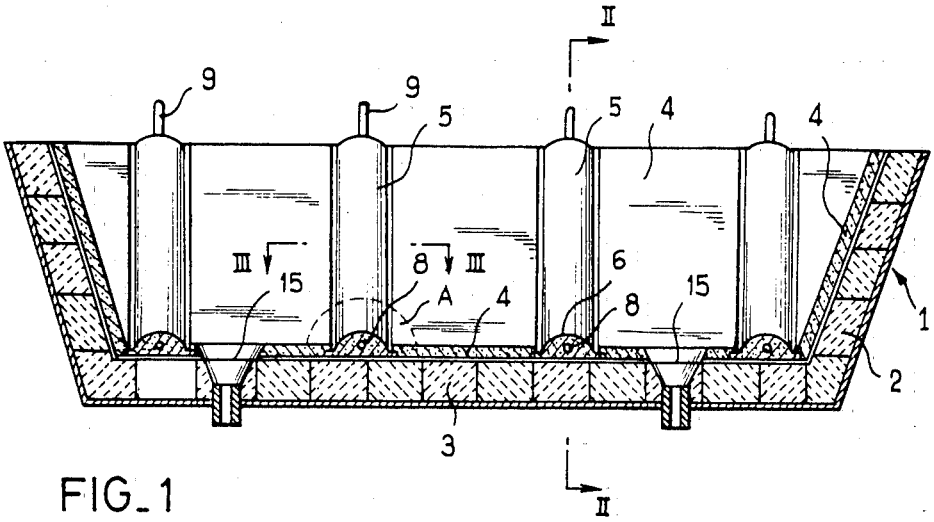
FIG. 1 is a longitudinal sectional view of a casting tundish equipped with a device according to the invention.
Figure 2:
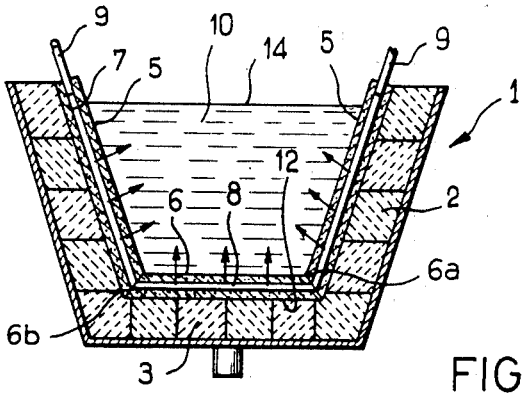
FIG. 2 is a sectional view taken along the plane II—II of FIG. 1.

In the embodiment of FIGS. 1 and 2, the casting tundish 1 has side walls 2 and a bottom wall 3 of refractory bricks covered with detachable plates of sinterable heat-insulating material composed of inorganic particles such as silica and/or alumina and/or magnesia, mineral or organic fibers embedded in an organic binder such as a phenolic adhesive or in an inorganic binder such as a refractory cement.

Blocks of elongated shape or "long blocks" 5, 6 are placed against the side walls 2 and the bottom wall 3 and between the plates 4. Ducts 7, 8 extend respectively within said long blocks 5, 6 from one end to the other in the longitudinal direction and are joined to a pipe 9 for the supply of inert gas such as argon.

The long blocks 5, 6 are formed of sinterable heat-insulating material of the same type as the material which forms the plates 4.

By way of example, the composition of this material in weight percent is as follows:

inorganic particles such as, for example, silica, alumina, magnesia or olivine: 70 to 90% mineral or organic fibers: 0 to 20% binder such as, for example, phenolic adhesive or refractory cement: 2 to 10% flux: 0 to 10%

A few examples relating to the composition of the long blocks 5, 6 are given hereunder:

EXAMPLE 1

Basic material $MgO$: 62 to 65%
$SiO_2$: 8 to 10%
$Cr_2O_3$: 3 to 6%
$Al_2O_3$: 3 to 6%
$Fe_2O_3$: 4 to 5%
$CaO$: 3 to 5%

Organic materials (binder and fibers) which are decomposable at high temperature: 6 to 8%

The total porosity of said material is:
prior to sintering: 52%
after sintering: 45%

The density of the material is within the range of 1.6 to 1.8.

EXAMPLE 2

Acid material $MgO$: 0 to 1%
$SiO_2$: 88 to 95%
$Al_2O_3$: 0 to 2%
$Fe_2O_3$: 0 to 1%
$CaO$: 0.5 to 2%

Organic materials which are decomposable at high temperature: 4 to 6%

Porosity:
prior to sintering: 54%
after sintering: 56%

Density: 1.2 to 1.4

EXAMPLE 3

Neutral material $SiO_2$: 35 to 42%
$Al_2O_3$: 0 to 2%
$CaO$: 0 to 3%
$MgO$: 38 to 48%
$Fe_2O_3$: 3 to 9%

Organic materials which are decomposable at high temperature: 2 to 8%

Porosity:
prior to sintering: 52%
after sintering: 53%

Density: 1.4 to 1.6

The effective size of the inorganic particles is of the order of a few microns. The fineness of said particles facilitates the sintering process.

The nature of the constituents of this composition, the effective size of the inorganic particles and the proportion of flux are so determined that the material sinters at the temperature of the molten metal 10 (usually steel) which is poured into the casting tundish 1.

The long blocks 5 extend to the full height of the side wall 2 of the casting tundish 1. The long blocks 6 are placed across the width of the casting tundish 1 and their opposite ends *6a*, *6b* are joined by means of beveled end faces to the end faces of the long blocks 5, as shown in FIG. 2. Thus the ducts 7 of each pair of long elements 5 which are placed against the side wall 2 of the casting tundish communicate with the duct 8 of the long element 6 which is placed on the bottom wall 3 of the tundish between the pair of long elements 5.

Figure 3:
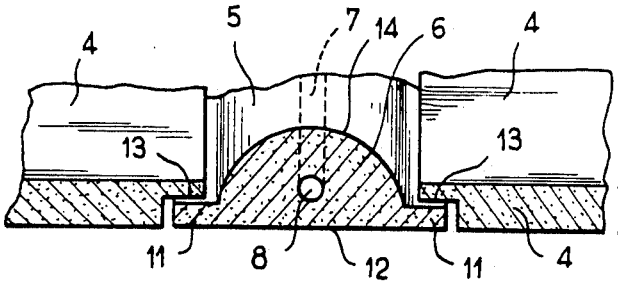
FIG. 3 is a view to a larger scale and showing the detail A of FIG. 1.

In the embodiment shown in FIGS. 1 to 3, the long blocks 5, 6 are inserted between the plates 4. As shown in FIG. 3, the longitudinal edges of said long blocks 5, 6 are provided for this purpose with flanges 11 located in the line of extension of their flat surface 12 which is adjacent to the side wall 2 or to the bottom wall 3. In the position of assembly, said flanges 11 are covered by shouldered portions 13 formed on the edges of the adjacent plates. The flat surface 12 of the blocks 5, 6 rests directly against the lateral wall 2 or the bottom wall 3 of the casting tundish 1. The surface 14 opposite to said flat surface 12 is substantially semi-cylindrical, with the result that a substantially constant distance is maintained between the duct 7 or 8 and the external surface of the blocks 5, 6.

It is apparent from FIG. 1 that the blocks 5, 6 are disposed at uniform intervals in groups of three blocks (two lateral blocks and one block at the bottom) in the longitudinal direction of the casting tundish 1.

The main technical effects of the device consisting of long blocks 5, 6 of sinterable heat-insulating material will be set forth in the description which now follows.

The binder which constitutes the blocks 5, 6 decomposes (in the case of a binder of organic material) or disintegrates (in the case of a binder of inorganic material) as it comes into contact with the molten metal 10 which is being poured into the tundish 1 (at a temperature of the order of 1300° C. in the case of steel), with the result that the block material becomes porous. Cohesion of the material is maintained as a result of sintering of the inorganic particles which thus produces a continuous action of the decomposed or disintegrated binder.

The argon introduced into the ducts 7, 8 passes through the porous material of the blocks 5, 6 and diffuses into the molten metal 10 contained in the casting tundish (as indicated by arrows in FIG. 2). By reason of the fact that the pores of the blocks 5, 6 have openings on the external surface of these latter at points located at uniform intervals on said surface, the argon jets are uniformly distributed along the entire external surface of each group of blocks 5, 6. There is thus formed at the level of each group of three blocks 5, 6 a veritable curtain or barrier of argon jets which are oriented towards the surface 14 of the molten metal bath 10. The argon is injected under a sufficient pressure (3 to 6 bar) to pass through the pores and to overcome the pressure exerted by the molten metal.

Impurities of metal or metalloid oxides in suspension in the molten metal 10 are driven by the argon jets towards the surface 14 of the metal bath 10 in which they are absorbed by the blanket powder (not shown in the drawings). These impurities are consequently not liable to flow with the metal through the pouring outlets 15 or to form any inclusions which would have a detrimental effect on the metal.

Figure 4:
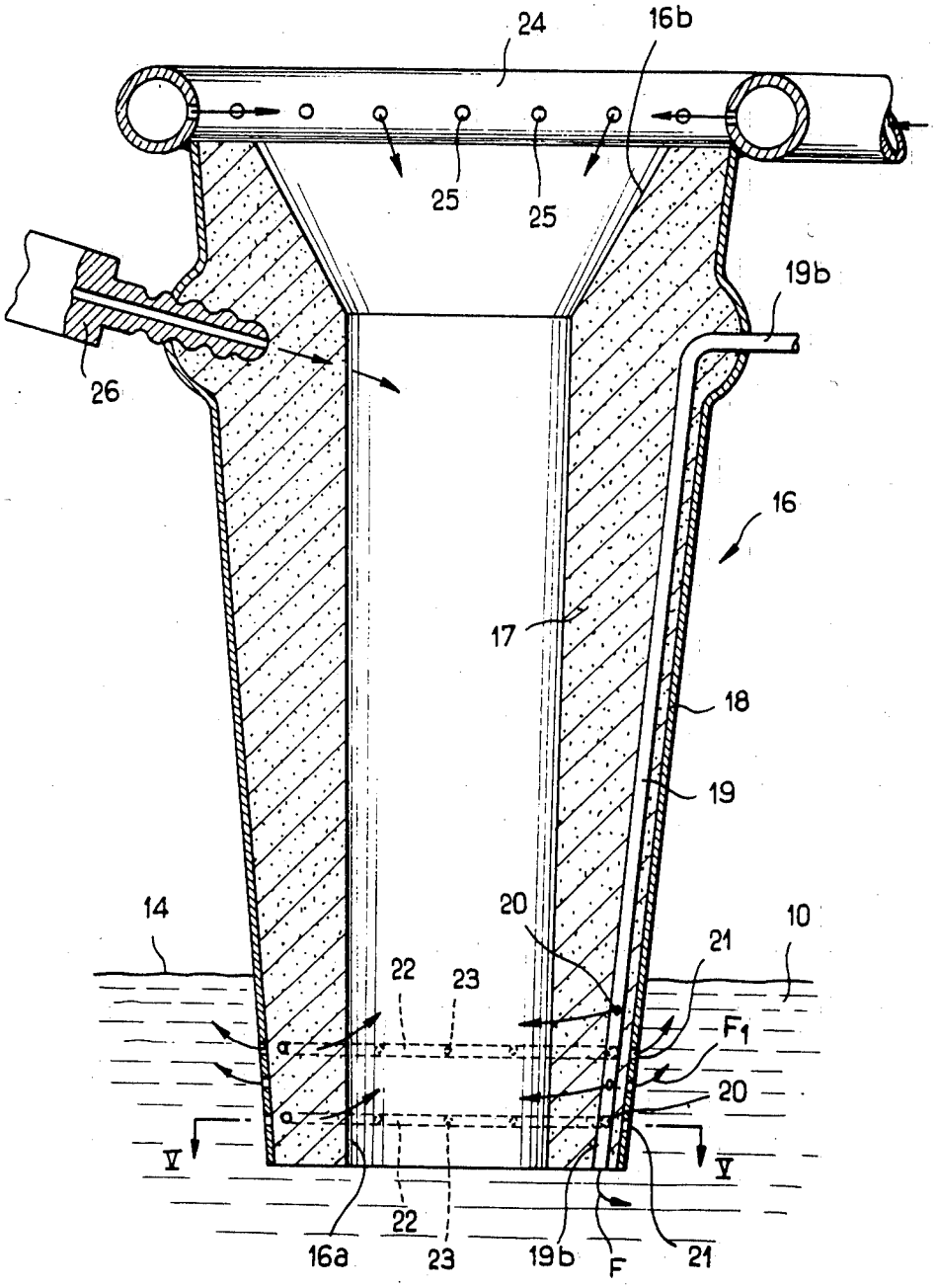
FIG. 4 is a longitudinal sectional view of a casting tube equipped with a device according to the invention.

In the embodiments of FIGS. 4 and 5, the casting tube 16 has a lower portion 16*a* immersed in the metal 10 which is poured into the tundish 1 through said tube. The upper portion 16*b* of said tube 16 is intended to be placed beneath the pouring outlet of a casting ladle (not shown in the drawings).

Said casting tube 16 is provided with an internal lining 17 of sinterable heat-insulating material of the same type as the material constituting the plates 4 and the long blocks 5, 6.

Said lining 17 is surrounded by a protective casing 18.

The casting tube 16 is provided with a pipe 19 which is embedded in the material of the lining 17 and intended to be connected to the supply of inert gas such as argon.

The upper end 19*a* of the pipe 19 has its opening outside the casting tube 16 and in proximity to the upper end 16*b* of said casting tube. The lower end 19*b* of the pipe 19 has its opening in the lower portion 16*a* of the casting tube, within the molten metal 10.

Said lower end 19*b* of the pipe 19 is provided with inert gas outlet orifices 20 which are in contact with the sinterable heat-insulating lining 17. Said orifices 20 are located opposite to openings 21 formed in the protective casing 18.

In addition, the lower end 19*b* of the pipe 19 is connected to annular pipes 22 disposed around the axis of the casting tube 16 and embedded in the lining 17. Said annular pipes 22 are provided with gas outlet holes 23 which are spaced at uniform intervals in the lining 17.

In the example illustrated in FIG. 4, the upper portion 16*b* of the casting tube 16 is also provided with an annular pipe 24 connected to the inert gas supply and pierced by orifices 25 for blowing inert gas into the interior of the casting tube 16.

Similarly, the side wall of the casting tube 16 is fitted with a nozzle 26 for blowing inert gas into the interior of the tube 16 through the lining 17.

The technical effects of the casting tube 16 described in the foregoing are as follows:

While the stream of molten metal 10 passes through the casting tube 16 (it is assumed that said tube is applied against the pouring outlet of the casting ladle in a substantially fluid-tight manner), argon is passed into the pipe 24, the nozzle 26 and the pipe 19.

The argon which is blown into the interior of the casting tube 16 through the pipe 24 and the nozzle 26 protects the molten metal against oxidation by atmospheric air which may have penetrated into the casting tube as a result of the negative pressure produced at the time of passage of the stream of molten metal.

The argon which is blown into the pipe 19 is discharged at the end 19*b* of this latter and passed into the molten metal 10. The argon is also discharged through the openings 20 and 23 into the interior of the casting tube 16 and to the exterior of said tube (via the openings 21) after having traversed the lining 17 through the pores formed after sintering of the material which constitutes said lining 17. The argon jets (as shown by the arrows F and $F_1$) which are formed in the molten metal 10 drive the impurities towards the surface of the molten metal bath, thus removing all inclusions which may have formed in the metal.

The argon jets formed in the immersion zone of the casting tube 16 thus have the combined effect, in conjunction with the jets discharged from the long blocks 5, 6 placed within the casting tundish 1, of eliminating inclusions in the metal which is being poured into said tundish 1.

In the embodiment of FIGS. 6 and 7, the pouring outlet 15 of the casting tundish 1 is lined with a detachable sleeve 27 of sinterable heat-insulating material of the same type as the material of the plates 4, of the blocks 5, 6 and of the lining 17 of the casting tube 16.

The upper portion of the sleeve 27 is provided with an annular flange 28, the peripheral edge 28*a* of which has a shouldered portion engaged beneath a complementary shouldered portion formed on the edge of the adjacent plates 4. Said annular flange 28 is provided with a circular pipe 29 which extends around the axis of the sleeve and is incorporated in the material of said sleeve, openings 30 being formed at uniform intervals along the entire periphery of said pipe for the discharge of inert gas.

Said circular pipe 29 is connected to an inert gas supply line 31 and this latter is housed within the space which is filled with powdered material 32 and located between the plates 4, the side walls 2 and the bottom wall 3 of the casting tundish 1.

The inert gas which is blown into the supply line 31 and into the circular pipe 29 passes through the material which has become porous after sintering of the sleeve 27, is discharged in the form of gas jets spaced at uniform intervals at the surface of the annular flange 28, and then penetrates into the molten metal 10, thus driving towards the surface of the bath any inclusions which would be liable to contaminate the metal.

The stopper rod 33 which is placed above the pouring outlet 15 and controls the opening and closing of said outlet is surrounded by a sleeve 34 in that portion of said stopper rod which is intended to be in contact with the molten metal 10. Said sleeve 34 is of sinterable heat-insulating material of the same type as the material which forms the plates 4, the blocks 5, 6, the lining 17 of the casting tube 16, and the sleeve 27.

A pipe 35 which is embedded in the material of the sleeve 34 extends vertically within this latter and is provided with orifices 36 for the discharge of inert gas. Said pipe 35 is connected to annular ducts 37 which are also provided with orifices in contact with the material of the sleeve 34.

The inert gas jets formed around the sleeve 34 through the material which has been made porous have the effect of displacing towards the surface of the molten metal any inclusions which may be present in said metal.

It is thus apparent that the different arrangements provided by the invention and comprising elements immersed in the molten metal at different points of the casting tundish make it possible to form gas jets in zones located at intervals within the metal bath at the immersed end of the casting tube 16, at the level of the pouring outlet 15 and around the stopper rod 33, said gas jets being directed towards the surface of the molten metal and capable of driving towards said surface all inclusions or impurities which would otherwise be liable to contaminate the metal.

The fact that the material constituting the blocks 5, 6, the lining 17 of the casting tube 16, the sleeve 27 and the sleeve 34 is made porous in contact with the molten metal makes it possible to obtain a plurality of gas jets which are distributed in a highly uniform manner over the surface of the elements of the devices according to the invention which produce an extremely effective repulsive action on the inclusions. Thus, when all the elements proposed by the invention are employed in combination, there no longer remains a single "dead" zone within the casting tundish 1. In other words, there no longer exists any zone which is unaffected by the inert gas jets and liable to contain inclusions or other impurities.

As can readily be understood, the invention is not limited to the examples described in the foregoing and consideration may accordingly be given to a large number of modifications without thereby departing either from the scope or the spirit of the invention.

Thus the shape of the blocks 5, 6, of the sleeves 27 and 34 and their arrangement within the casting tundish 1 can be different from the arrangement of the elements shown in the drawings. Furthermore, the method adopted for introducing inert gas into the interior of said elements can be modified if necessary.

Thus the ducts 7 and 8 and the pipes provided for the supply of inert gas within the elements of the device according to the invention could have a sinuous contour in order to increase the contact area between the inert gas and the material of said elements.

Furthermore, the blocks 5, 6, the sleeves 27, 34 and the lining 17 of the casting tube 16 could be provided with pre-bored ducts of small cross-sectional area for connecting the inert gas supply pipe to that surface of said elements which is in contact with the molten metal. Said ducts could thus facilitate the diffusion of inert gas through the material of said elements, especially prior to formation of the pores which result from decomposition or disintegration of the binder.

In the case of the casting tube 16 shown in FIG. 4, the design in which a pipe 19 is embedded in the lining 17 can be replaced by the design adopted for the long blocks 5, 6 in which a duct is preformed in the lining 17. Said duct may or may not extend to the full height of the lining provided that the inert gas is capable of diffusing through said lining and penetrating into the molten metal at the level of the immersed portion of this latter.

Moreover, the upper portion **16*b* and/or the lower portion 16*a* of the lining 17** can be provided with a protective ring of heat-resistant material as described in patent application No. PCT/FR 80/00169 filed on Nov. 26th, 1980 by the present applicant. Said protective ring can be of iron, of steel or of any other material which has comparable thermal and mechanical properties.

What is claimed is:

1. A device for removing inclusions from molten metal, in which the molten metal is poured into a casting tundish through a casting tube immersed in the molten metal contained in said tundish, said casting tube being provided internally with a lining of heat-insulating material, which is sinterable at the temperature of the molten metal poured into said casting tube and becomes porous after sintering, wherein said casting tube comprises a pipe embedded in the sinterable heat-insulating lining, one end of said pipe being adapted to be connected to an inert gas supply and being located at the upper portion of said tube and the other end of the pipe having a gas outlet at the lower end of the casting tube in contact with the molten metal which is poured into the casting tundish, the pipe adjacent said other end having at least one gas outlet orifice (20) in contact with the sinterable heat-insulating lining, the pores formed in the lining after sintering enabling gas to flow from said orifice to the external surface of said lining, and a protective casing externally surrounding said sinterable heat-insulating lining, said casing having openings located opposite the orifices of the inner gas feed pipe.

2. A device according to claim 1, wherein the lower end of the inert gas feed pipe is connected to at least one annular pipe embedded in the lining and provided with gas outlet orifices in contact with said lining.

* * * * *